US007444915B2

(12) United States Patent
Kovacic et al.

(10) Patent No.: US 7,444,915 B2
(45) Date of Patent: Nov. 4, 2008

(54) FOOD SLICER AND DRIVE UNIT FOR A SLICER

(75) Inventors: Peter Kovacic, Gomilska (SI); Aleksander Sedovsek, Mozirje (SI)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 323 days.

(21) Appl. No.: 10/928,219

(22) Filed: Aug. 27, 2004

(65) Prior Publication Data

US 2005/0050741 A1 Mar. 10, 2005

Related U.S. Application Data

(63) Continuation of application No. PCT/EP03/01756, filed on Feb. 20, 2003.

(30) Foreign Application Priority Data

Feb. 27, 2002 (DE) ..... 102 08 492

(51) Int. Cl.
*B26D 7/06* (2006.01)

(52) U.S. Cl. ..... 83/707; 83/932

(58) Field of Classification Search ..... 83/707, 83/932, 663; 74/421 A
See application file for complete search history.

(56) References Cited

U.S. PATENT DOCUMENTS

| | | | | | |
|---|---|---|---|---|---|
| 2,771,786 | A | * | 11/1956 | Gilbert et al. | 74/421 R |
| 4,246,821 | A | * | 1/1981 | Fuse | 83/707 |
| 4,273,013 | A | * | 6/1981 | Artin et al. | 83/707 |
| 4,345,498 | A | * | 8/1982 | Best | 83/707 |
| 4,520,703 | A | * | 6/1985 | Speckhart | 83/707 |
| 5,298,821 | A | | 3/1994 | Michel | |
| 5,934,143 | A | | 8/1999 | Dibbern, Jr. et al. | |

FOREIGN PATENT DOCUMENTS

| | | | |
|---|---|---|---|
| DE | 807 578 | | 7/1951 |
| DE | 82 17 628.0 | U1 | 11/1982 |
| DE | 44 32 973 | A1 | 3/1996 |
| DE | 197 04 110 | A1 | 8/1998 |
| GB | 2 321 865 | A | 8/1998 |

* cited by examiner

*Primary Examiner*—Stephen Choi
(74) *Attorney, Agent, or Firm*—Russell W. Warnock; James E. Howard

(57) ABSTRACT

A drive unit for a food slicer has a housing and a bearing plate inside the housing. The bearing plate carries a transmission which transfers the rotation of a drive motor coupled to the mechanism to a circular blade that is rotatably mounted in a first bearing. The bearing plate has the first bearing for the circular blade, and the housing is provided with an opening through which the first bearing can be accessed from outside the housing. The slicer has the advantage of being especially quiet.

20 Claims, 2 Drawing Sheets

FOOD SLICER AND DRIVE UNIT FOR A SLICER

CROSS-REFERENCE TO RELATED APPLICATION

This is a continuing application, under 35 U.S.C. § 120, of copending international application No. PCT/EP03/01756, filed Feb. 20, 2003, which designated the United States; this application also claims the priority, under 35 U.S.C. § 119, of German patent application No. 102 08 492.0, filed Feb. 27, 2002; the prior applications are herewith incorporated by reference in their entirety.

BACKGROUND OF THE INVENTION

Field of the Invention

The invention relates to slicers, such as food slicers and universal slicers. More particularly, the invention pertains to a food slicer and a drive unit for the food slicer. The slicer has a housing and having a bearing plate inside the housing. A transmission transmits the rotation of a drive motor, which is coupled to the transmission, to a circular cutting blade disposed outside the housing and rotatably mounted in a first bearing.

German utility model DE 82 17 628 U1 (Gebrauchsmuster) discloses a drive unit for a food slicer. The drive unit comprises an electric motor which is accommodated in a housing in the form of a shell and whose motor shaft ends in a drive worm, which drives a blade disk via a transmission. The blade disk is screwed to a bearing shaft by means of a holding disk and a threaded part, and the bearing shaft is mounted in a supporting eye in the housing. The electric motor and a drive gearwheel which engages with the motor shaft are mounted on a bearing plate. The bearing plate is connected to the housing by means of screws.

This prior art drive unit for a food slicer has the disadvantage that the blade disk is mounted in the housing, and the drive unit is mounted on a bearing plate which is separate from the housing. During the assembly of the drive unit, particular care must be taken there to ensure that the bearing plate on which the drive unit is located is aligned with respect to the blade disk bearing. Particularly if it is intended to replace the elastic toothed belt drive by a direct drive, tight installation tolerances must be complied with between the bearing plate and the bearing for the blade disk.

SUMMARY OF THE INVENTION

It is accordingly an object of the invention to provide a food slicer and a drive unit for a slicer which overcomes the above-mentioned disadvantages of the heretofore-known devices and methods of this general type and which provides for a food slicer which has a simplified drive unit. One particular object is to simplify the assembly of the drive unit. A further object of the invention is to provide a drive unit for a food slicer which operates particularly quietly. An additional object is to extend the life of the food slicer, even though the drive unit is simpler.

With the foregoing and other objects in view there is provided, in accordance with the invention, a slicer with a circular cutting blade and a drive unit for driving the blade.

The drive unit comprises:

a housing formed with an opening;

a drive motor for driving the cutting blade;

a transmission coupled to said drive motor for driving the circular blade disposed outside said housing; and a bearing plate disposed in said housing and having a cutting blade bearing rotatably mounting the circular cutting blade, and being disposed to be accessible from outside said housing.

The integration of the bearing for the circular blade in the bearing plate which also has the bearing points for the transmission results in the drive unit being physically compact. A further advantage is the reduction in the number of parts. The reduced number of parts allows low-cost manufacture, and simpler assembly. The particularly stiff connection between the transmission and the circular blade bearing makes it possible to provide tight installation tolerances, thus resulting in a very quiet drive. Improved dimensional stiffness and positioning stiffness of the transmission and bearing connection makes it possible to comply more accurately with shaft separations, thus reducing the wear to the gearwheels and extending the life.

In a further refinement, latching tabs, by way of which the bearing for the circular blade is positioned and fixed with respect to the opening in the housing, are integrally formed on the inside of the housing. The bearing plate is thus attached to the inside of the housing via a detachable snap-action connection. During assembly of the food slicer, the preassembled unit which is formed by the transmission, bearing plate and first bearing of the circular blade just has to be pressed onto the snap-action connection on the inside of the housing in order to attach the complete drive unit to the housing of the food slicer. This has the advantage that no additional process steps are required for the attachment process, and there is no need for any additional attachment means. In particular, it is possible to save screws and similar detachable attachment means. A particularly dimensionally stiff material with bearing qualities may be used for the bearing plate.

The latching tabs may be mounted in the vicinity of the opening of the housing. By way of example, three latching tabs may be integrally formed on the edge of the opening of the housing, through which the rotation axis of the circular blade runs, which latching tabs are offset through 120° and engage behind three associated latching grooves on the first bearing of the bearing plate, thus fixing the bearing plate on the inside of the housing. This type of attachment is not only particularly suitable for large-scale production, but at the same time also guarantees particularly accurate positioning of the bearing for the circular blade, and securing in position, with respect to the opening. The use of the snap-action connections and of the latching tabs on the housing has the advantage that this reduces the range of parts. Since the bearing plate should preferably be formed from a very stiff material and the housing may be composed of a relatively soft material, it is particularly worthwhile integrally forming the snap-action connection and the latching tabs on the housing, since the softer materials of the housing allows a certain amount of elasticity for the snap-action connection.

In one preferred embodiment, the first bearing for the circular blade is in the form of a hub, wherein a bearing journal is detachably mounted, on which the circular blade is mounted such that it can rotate. In order to allow the circular blade to be cleaned easily, it is detachably connected to the drive of the food slicer. In order to attach the circular blade to the drive unit, the central opening in the circular blade is placed on the bearing journal, and is mounted on it such that it can rotate. The bearing journal is inserted together with the circular blade placed on it into the hub of the first bearing, and is locked in this hub. The circular blade can rotate freely on the bearing journal, and is at the same time positioned accurately with respect to the drive unit. Since the bearing plate is fitted not only with the transmission but also with the circular blade, which is mounted such that it can rotate, this results in the entire drive unit comprising the motor transmission and circular blade being very robust.

In one preferred embodiment, the bearing plate has a second bearing, which is arranged at a distance from the first bearing for the circular blade, and this second bearing is fitted with the transmission. This results in a transmission design which allows a very flat configuration, that is to say the entire food slicer can be produced with a very narrow width.

In one advantageous variant, the transmission comprises a drive gearwheel, which is coupled to an output drive gearwheel which engages in a toothed rim which is attached to the circular blade. If the circular blade is not driven directly on its rotation axis, but as far outwards as possible in the vicinity of the external circumference of the circular blade, the diameter of a toothed rim which is attached there may be relatively large, and the output drive gearwheel which engages in the toothed rim may be designed to have as small a diameter as possible, thus resulting in the advantage that as high a step-up ratio as possible can be achieved in one transmission stage, and the circular blade can be operated at a low rotation speed, but with high torque. The use of a toothed rim and output drive gearwheel with oblique teeth has the further advantage that this allows a largely backlash-free drive.

The drive gearwheel and the output drive gearwheel can be connected to one another such that they cannot rotate with respect to one another. It is particularly advantageous for the drive gearwheel and the output drive gearwheel to be manufactured integrally. This reduces the large number of components and allows the drive gearwheel and the output drive gearwheel to be connected as stiffly as possible. This makes it possible to produce a very compact transmission which has two transmission gears.

A flange, against which the drive motor is positioned by means of holding elements with elastic characteristics, is advantageously integrally formed on the bearing plate. The motor is flange-connected directly to the bearing plate, to which the transmission is fitted, by means of such holding elements. The motor is thus not attached to the housing of the food slicer, and, instead, the motor is attached to the bearing plate, and the bearing plate is fixed to the inside of the housing. This has the advantage that, not only do the transmission and the bearing plate form a unit, but the drive motor is also integrated in the unit which comprises the transmission and the bearing plate. This has the advantage that there is no need for separate attachment of the drive motor to the housing of the food slicer. This simplifies assembly, and there is no need for any additional attachment means.

The holding elements with elastic characteristics may be in the form of sprung latching hooks, whose holding tabs engage in openings on the motor housing. The attachment means formed in this way attach the drive motor to the flange of the bearing plate by pressing the motor housing against the flange in the axial direction.

At least two latching hooks are preferably provided and are integrally formed opposite one another on the bearing plate and the flange, respectively, wherein case an elastic section may be formed between the latching hooks and the flange. The motor is thus prestressed in a sprung manner in the axial direction against the bearing plate and against the flange. The elastic sections make it possible to compensate for shape and positioning tolerances of the drive motor and of the openings on the motor housing.

In one preferred embodiment, the motor shaft of the drive motor is fitted with a worm which engages with the drive gearwheel. The worm and drive gearwheel form a first transmission stage with a high step-up ratio. The drive gearwheel preferably forms a unit with the output drive gearwheel. The output drive gearwheel and the toothed rim on the circular blade form a second transmission stage, which likewise has a high step-up ratio. This makes it possible to produce a two-gear transmission with a very high step-up ratio. This has the advantage that it is possible to use a relatively small drive motor with a high rotation speed, and the circular blade is operated at a very low rotation speed, but with high torque.

The worm gear of the drive motor is advantageously rolled directly onto the motor shaft once the drive motor has been assembled. The known drive motors for food slicers normally have a motor shaft which has a step onto which a separate worm is pressed or shrunk. According to the invention, the preassembled drive motor has a motor shaft without a step. Once the drive motor has been assembled, the worm is then rolled directly onto the smooth shaft. This reduces the manufacturing costs. Rolling the worm onto a smooth motor shaft saves, in particular, the process of producing a step on the motor shaft, since there is no need for any step on the motor shaft. In contrast, the known drive motors require a shaft step in order to form a seat for the separate worm. Furthermore, the separate worm for the known drive motors is manufactured by machining, which is a relatively costly manufacturing step. Furthermore, the separate worm must be mounted on the motor shaft of the drive motor. In contrast to this, rolling the worm onto a smooth motor shaft is less costly and allows one assembly step to be avoided.

The end face of the free end of the motor shaft of the drive motor, to which the worm is fitted, may rest on an axial bearing which is arranged on the bearing plate. Since the pinion of the drive motor may be in the form of a worm, it is necessary to ensure that forces which occur in the axial direction on the motor shaft are supported axially by a bearing. This prevents axial displacement of the motor shaft when the motor is driving the drive gearwheel by means of the worm. The axial bearing can be mounted in a holder which is integrally formed in the bearing plate.

The food slicer according to the invention has a drive unit which is very stiff and compact overall. This compact, stiff design allows very tight manufacturing tolerances to be achieved. The tight manufacturing tolerances allow a largely backlash-free drive which is distinguished by extremely low noise and allows the food slicer to be operated with little vibration. It is therefore preferable to operate the food slicer according to the invention with a d.c. motor. The use of a d.c. motor is advantageous since the motor can be operated at a low rotation speed, thus avoiding undesirable vibration of the drive and, because of the reduced vibration, there is no need for a rubber bearing for the drive unit on the housing of the food slicer. Despite the direct attachment of the drive unit to the housing of the food slicer, the food slicer operates with very little noise.

Other features which are considered as characteristic for the invention are set forth in the appended claims.

Although the invention is illustrated and described herein as embodied in a food slicer having a drive unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
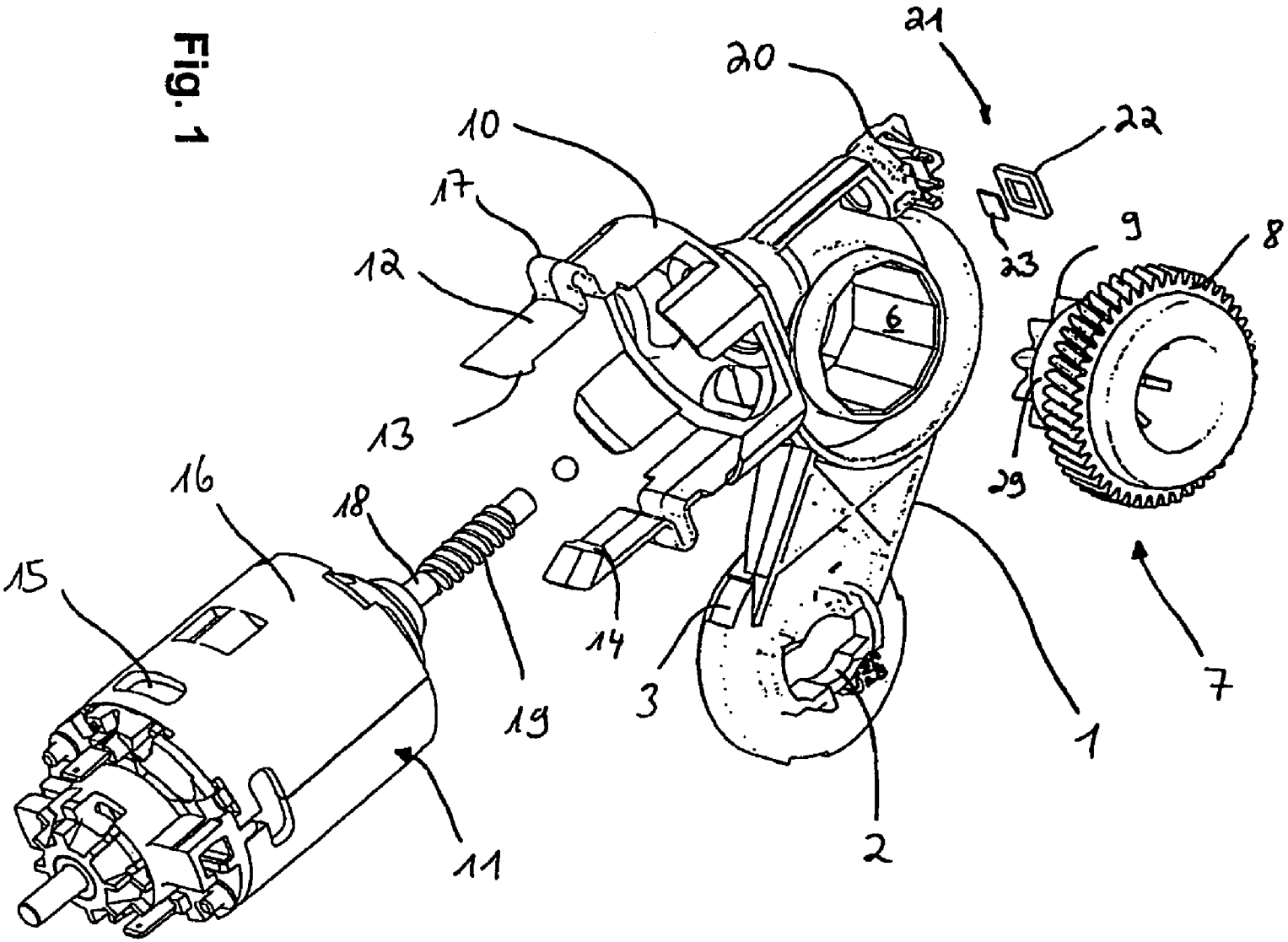
FIG. 1 is an exploded perspective view of the drive unit of the food slicer according to the invention.

Referring now to the figures of the drawing in detail and first, particularly, to FIG. 1 thereof, there is shown a bearing plate 1 with a first bearing 2, which is in the form of a hub. The first bearing 2, also referred to as the cutting blade bearing 2, is formed by means of an aperture, which is similar to a keyhole, in a section of the bearing plate 1 which is in the form of a disk and, on its outer edge, has three grooves 3. A second bearing 6 is integrally formed on the bearing plate 1, at a distance from the first bearing 2. The second bearing 6 is formed by a tubular section, which is integrally formed on the bearing plate 1. The tubular section passes through the planar bearing plate 1 and projects on the side facing a transmission 7, with the projection acting as a bearing seat for the transmission 7.

The transmission 7 is an integral plastic component and is fitted with an obliquely toothed drive gearwheel 8 and an obliquely toothed output drive gearwheel 9. On the side facing the output drive gearwheel 9, the drive gearwheel 8 has an annular groove, which holds the tubular section of the second bearing 6. The inside of the second bearing 6 is polygonal. The drive gearwheel 8 and the output drive gearwheel 9 are connected to one another via a cylindrical section 29. The cylindrical section 29 rests on the polygonal second bearing 6, touching it on a line. In the installed state, the transmission 7, which comprises the drive gearwheel 8 and the output drive gearwheel 9, is mounted on the second bearing 6 such that it can rotate. Together with the second bearing 6, the bearing plate 1 forms a first housing half of the transmission housing.

The first bearing 2 is connected to the second bearing 6 via a web-like section of the bearing plate 1. In order to increase the stiffness, this web-like section has reinforcing ribs, which are integrally formed on the bearing plate 1. A flange 10 is integrally formed on the bearing plate 1, at the side of the second bearing 6. The flange 10 forms a holder for a drive motor 11. Two opposite holding elements 12 are integrally formed on the flange 10. At its free end, each of the holding elements 12 in each case has a latching hook 13. Each latching hook 13 has a holding tab 14 which engages in a respective cutout 15 on the motor housing 16 of the drive motor 11. If the front end of the drive motor 11, to which a worm 19 is fitted, is inserted first of all into the bearing plate 1, the latching hooks 13 snap into the cutouts 15 in the motor housing 16 for the drive motor 11, and the drive motor 11 is fixed such that it rests on the flange 10. The elasticity of the holding element 12 is in each case provided by an elastic section 17 on the holding elements 12. When the drive motor 11 is fixed to the flange 10, the motor shaft 18 of the drive motor 11 projects into the interior of the first housing half, and the worm 19 which is rolled onto the motor shaft 18 then engages with the obliquely toothed drive gearwheel 11. A holder 20 is integrally formed on the bearing plate 2 at one end of the bearing plate 1, which is opposite the flange 10, and is fitted with an axial bearing 21. The axial bearing 21 is formed by a metallic baseplate 22, wherein a hard material plate 23 is inserted. The baseplate 22 fitted with the hard material plate 23, is pushed into the holder 20, and is latched there.

Figure 2:
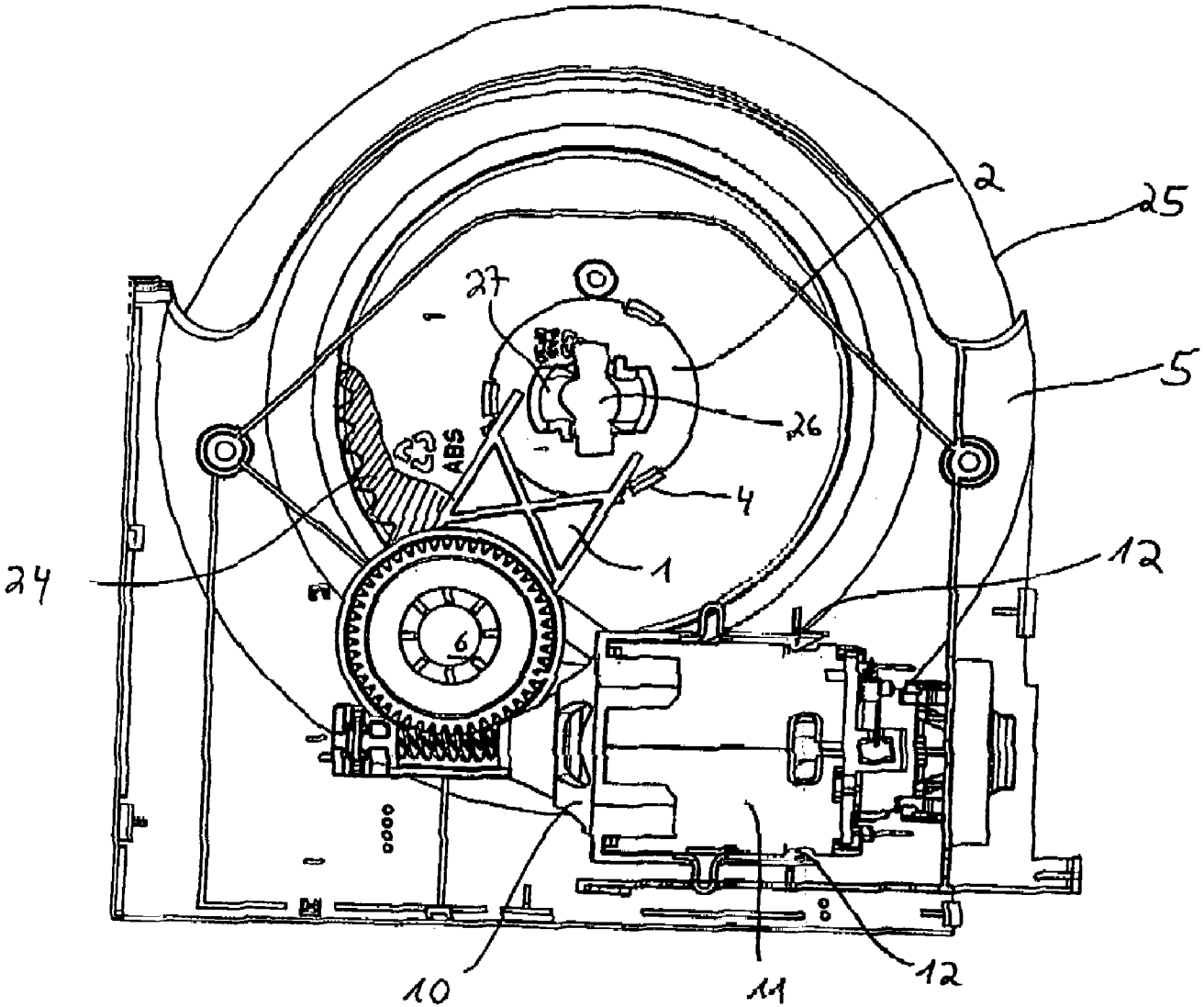
FIG. 2 is a side view of the drive unit according to the invention in the installed state.

FIG. 2 shows the assembled unit comprising the bearing plate 1, the drive motor 11 and the first bearing 2 of the circular blade 25, in the assembled form of a subunit.

The first bearing 2, formed with the three grooves 3, is latched into associated latching tabs 4 on a housing 5. The housing 5 may also be referred to as a support frame or a subunit frame. The three latching tabs 4 are integrally formed directly on the inside of the housing 5, and, together with the grooves 3, form the snap-action connection. The bearing plate 1 is attached to the housing 5 by means of this snap-action connection. The drive motor 11 is attached to the flange 10 on the bearing plate 1 by way of the holding elements 12. The transmission 7 is mounted in the second bearing 6 in the bearing plate 1. A toothed rim 24 is mounted to or formed on the circumference of a circular blade 25. A bearing journal 26 is detachably mounted in the first bearing 2, which is in the form of a hub. The bearing journal 26 projects through an opening 27 in the housing 5 on the outside of the housing 5. The circular cutting blade 25 is mounted on the bearing journal 26 such that it can rotate.

Additional information concerning the mounting of the drive unit according to the invention in an exemplary household food slicer may be found, by way of example, in the commonly assigned, copending international application PCT/EP03/01754, which is herewith incorporated by reference.

We claim:

1. An assembly for a slicer, the slicer having a circular blade, a drive motor for drivingly rotating the circular blade, a blade shaft mounted to the circular blade and supported for rotation of the circular blade about a blade rotation axis that extends through the blade shaft, and a drive engagement means on the circular blade extending angular about the blade rotation axis at a radial spacing from the blade rotation axis, the assembly comprising:

a.) an assembly housing having an opening for receiving the blade shaft of the circular blade inserted thereinto, whereby the blade shaft of the circular blade is free to rotate while received in the opening of the assembly housing;

b.) a transmission support for supporting a transmission that is coupled to the drive motor and that has a rotating transmission transfer portion in engagement with the drive engagement means on the circular blade such that the transmission transfer portion rotates in response to an output to the transmission by the drive motor to effect rotation of the circular blade, the transmission support being operable to support the rotating transmission transfer portion of the transmission for rotation about a transfer rotation axis that is radially spaced from the blade rotation axis of the blade shaft of the circular blade that has been inserted into the opening of the assembly housing; and c.) an interconnecting structure connecting the assembly housing and the transmission support to one another in a fixed relationship in which, in an assembled condition of the assembly mounted on the slicer and the assembly housing is disposed for receiving a blade shaft of a circular blade, the transmission support is maintained at a position for supporting the transmission transfer portion of the transmission that is in engagement with the drive engagement means on the circular blade such that the transmission transfer portion effects rotation of the circular blade, the assembly housing, the transmission support, and the interconnecting structure being connected to one another to thereby form a single unit to be disposed between a pair of spaced apart walls of the slicer in the assembled condition and being removable as a single unit from its assembled condition within the slicer.

2. The assembly according to claim 1 and further comprising a holder for supporting the drive motor in a fixed relation relative to the transmission supported by the transmission support.

3. The assembly according to claim 2, wherein the holder is configured for supporting the drive motor having a drive output shaft that rotates about a drive output axis, the opening of the assembly housing is configured to receive the blade shaft of the circular blade such that the circular blade is supported for rotation in a blade plane, and the holder is configured to support the drive motor such that the drive output shaft of the drive motor is substantially parallel to the blade plane.

4. The assembly according to claim 1, wherein the assembly housing includes a circular blade bearing forming the opening and further comprising latching tabs for fixedly securing the circular blade bearing with respect to the opening.

5. The assembly according to claim 4, wherein the latching tabs are disposed in the vicinity of the opening.

6. The assembly according to claim 4, wherein the circular blade bearing includes a hub with a bearing journal detachably mounted therein, the bearing journal for supporting a blade shaft of a circular blade.

7. The assembly according to claim 1, wherein the transmission support is configured to support a transmission having a transmission transfer portion in the form of a drive gearwheel operable to engage a drive engagement means of a circular blade in the form of a toothed rim extending angularly around the circular blade.

8. The assembly according to claim 1, wherein the transmission support is configured to support a transmission having a transmission transfer portion in the form of an output drive gearwheel and a drive gearwheel with the drive gearwheel being operable to engage a drive engagement means of a circular blade in the form of a toothed rim extending angularly around the circular blade and the drive gearwheel and the output drive gearwheel are connected non-rotatably to one another.

9. The assembly according to claim 1, wherein the transmission support is configured to support a transmission having a transmission transfer portion in the form of an output drive gearwheel and a drive gearwheel with the drive gearwheel being operable to engage a drive engagement means of a circular blade in the form of a toothed rim extending angularly around the circular blade and the drive gearwheel and the output drive gearwheel are integrally formed.

10. The assembly according to claim 1, wherein the assembly is configured for insertion into a housing of a household slicer.

11. A slicer comprising:

a.) a circular blade;

b.) a drive motor for drivingly rotating the circular blade;

c.) a pair of spaced apart walls;

d.) a blade shaft mounted to the circular blade and supported for rotation of the circular blade about a blade rotation axis that extends through the blade shaft;

e.) a drive engagement means on the circular blade extending angular about the blade rotation axis at a radial spacing from the blade rotation axis;

f.) a transmission coupled to the drive motor and having a rotating transmission transfer portion in engagement with the drive engagement means on the circular blade such that the transmission transfer portion rotates in response to an output to the transmission by the drive motor to effect rotation of the circular blade; and g.) an assembly including:

an assembly housing having an opening for receiving the blade shaft of the circular blade inserted thereinto, whereby the blade shaft of the circular blade is free to rotate while received in the opening of the assembly housing;

a transmission support for supporting the transmission such that the rotating transmission transfer portion rotates about a transfer rotation axis that is radially spaced from the blade rotation axis of the blade shaft of the circular blade that has been inserted into the opening of the assembly housing; and an interconnecting structure connecting the assembly housing and the transmission support to one another in a fixed relationship in which, in an assembled condition of the assembly mounted on a slicer and the assembly housing is disposed for receiving the blade shaft of the circular blade, the transmission support is maintained at a position for supporting the transmission transfer portion of the transmission that is in engagement with a drive engagement means on the circular blade such that the transmission transfer portion effects rotation of the circular blade, the assembly being disposable within the slicer housing between the pair of spaced apart walls in an assembled condition and being removable as a single unit from its assembled condition position within the slicer housing.

12. The slicer according to claim 11 and further comprising a holder for supporting the drive motor in a fixed relation relative to the transmission supported by the transmission support.

13. The slicer according to claim 12, wherein the holder is configured for supporting the drive motor having a drive output shaft that rotates about a drive output axis, the opening of the assembly housing is configured to receive the blade shaft of the circular blade such that the circular blade is supported for rotation in a blade plane, and the holder is configured to support the drive motor such that the drive output shaft of the drive motor is substantially parallel to the blade plane.

14. The slicer according to claim 11, wherein the assembly housing includes a circular blade bearing forming the opening and further comprising latching tabs for fixedly securing the circular blade bearing with respect to the opening.

15. The slicer according to claim 14, wherein the latching tabs are disposed in the vicinity of the opening.

16. The slicer according to claim 14, wherein the circular blade bearing includes a hub with a bearing journal detachably mounted therein, the bearing journal for supporting a blade shaft of a circular blade.

17. The slicer according to claim 11, wherein the transmission support is configured to support a transmission having a transmission transfer portion in the form of a drive gearwheel operable to engage a drive engagement means of a circular blade in the form of a toothed rim extending angularly around the circular blade.

18. The slicer according to claim 11, wherein the transmission support is configured to support a transmission having a transmission transfer portion in the form of an output drive gearwheel and a drive gearwheel with the drive gearwheel being operable to engage a drive engagement means of a circular blade in the form of a toothed rim extending angularly around the circular blade and the drive gearwheel and the output drive gearwheel are connected non-rotatably to one another.

19. The slicer according to claim 11, wherein the transmission support is configured to support a transmission having a transmission transfer portion in the form of an output drive gearwheel and a drive gearwheel with the drive gearwheel being operable to engage a drive engagement means of a circular blade in the form of a toothed rim extending angularly around the circular blade and the drive gearwheel and the output drive gearwheel are integrally formed.

20. The slicer according to claim 11 and further comprising means for detachably securing the blade shaft of the circular blade to the assembly.

* * * * *